US006295924B1

(12) United States Patent
Nishihata et al.

(10) Patent No.: US 6,295,924 B1
(45) Date of Patent: Oct. 2, 2001

(54) STENCIL PRINTING APPARATUS

(75) Inventors: Masahiro Nishihata; Yoshikazu Murayama; Yoshihiro Hayashi, all of Ibaraki-ken (JP)

(73) Assignee: Riso Kagaku Corporation, Tokyo (JP)

( * ) Notice: Subject to any disclaimer, the term of this patent is extended or adjusted under 35 U.S.C. 154(b) by 0 days.

(21) Appl. No.: 09/435,479

(22) Filed: Nov. 8, 1999

(30) Foreign Application Priority Data

Nov. 12, 1998 (JP) ..... 10-322185
Oct. 4, 1999 (JP) ..... 11-283021

(51) Int. Cl.[7] ..... B41L 13/06
(52) U.S. Cl. ..... 101/116; 101/484
(58) Field of Search ..... 101/114, 116, 101/119, 120, 129, 484

(56) References Cited

U.S. PATENT DOCUMENTS 4,791,866 * 12/1988 Kanno et al. ..... 101/129
5,060,567 * 10/1991 Hayama et al. ..... 101/120
5,140,898 8/1992 Igarashi ..... 101/120
5,517,913 * 5/1996 Oshio et al. ..... 101/119
5,537,920 * 7/1996 Hasegawa et al. ..... 101/116
5,632,200 * 5/1997 Fukai ..... 101/116
5,699,731 * 12/1997 Hara ..... 101/119
6,026,744 * 2/2000 Miyata ..... 101/116
6,076,458 * 6/2000 Ohno ..... 101/119
6,095,040 * 8/2000 Ashikagaya et al. ..... 101/120
6,158,337 * 12/2000 Hara ..... 101/116

* cited by examiner

*Primary Examiner*—Stephen R. Funk
(74) *Attorney, Agent, or Firm*—Kanesaka & Takeuchi

(57) ABSTRACT

A stencil printing apparatus includes a main body, a drum unit having a drum substantially in a cylindrical shape and attachable to and detachable from the main body, a drum detecting device for detecting a kind of the drum unit mounted to the main body and a control device for carrying out an auto idling operation prior to a successive perforating operation in a case when a non-operational time period of the main body exceeds a previously set time period or when the drum detecting device detects interchanging of the drum unit.

18 Claims, 11 Drawing Sheets

STENCIL PRINTING APPARATUS

BACKGROUND OF THE INVENTION

1. Field of the Invention:

The present invention relates to a stencil printing apparatus for carrying out printing by using stencil sheet, particularly to a stencil printing apparatus capable of immediately carrying out normal printing even when the apparatus has been left to a nonprinting state for a long period of time.

2. Description of the Related Art

In the printing operation of a stencil printing apparatus, a stencil sheet perforated by a perforating section is wrapped around a drum and thereafter, a sheet supply section supplies a print sheet to the drum. A press roller presses the print sheet to the drum to thereby carry out the printing and the printed sheet is discharged to a sheet discharging section.

According to such a stencil printing apparatus, when the apparatus is left without carrying out the printing operation for a long period of time, ink at inside of the drum or on the surface of the drum is dried or deteriorated. Therefore, when the printing operation is newly started after the apparatus has been left to the nonprinting state, there causes a problem in which image blur on a print sheet or a dispersion in print density occurs and a number of incomplete printed sheets referred to as "failure printed sheets" are discharged during a time period until normal printing is carried out in which an image is uniformly printed on the print sheet. The problem increases the printing cost and the printing time.

In order to resolve the above-described problem, according to an apparatus disclosed in Japanese Unexamined Patent Publication No. 3-175081, there is provided a mode referred to as "automatic idling mode".

According to the mode, a time point at which the perforating operation and printing operation have finally been carried out is memorized to the apparatus and then a time interval between the memorized time point and a current time point is calculated in the next perforating operation. When the calculated non-operational time period is equal to or more than a set value of the automatic idling mode, nonperforated master sheet is wrapped around the drum, a pressing operation the same as that in printing is carried out without supplying sheet by which ink is made adaptable.

According to the above-described constitution, when one drum unit is used for one apparatus, the function is sufficiently achieved and the failure can be prevented. However, when a plurality of drums is used for one machine, although the automatic idling mode is operated for a drum unit which is initially used, when the drum unit is interchanged by another drum unit, the automatic idling mode is not operated to the interchanged drum unit and failure occurs in order to obtain proper printed matter.

For example, three drum units holding respectively different inks are used to obtain printed matter having three colors. First, a predetermined number of print sheets are printed by a first color ink in a state in which a drum unit for the first color is mounted to the apparatus, thereafter, the drum unit of the first color is interchanged by a drum unit of a second color and the print sheet which has already been printed with the first color is overlappingly printed by second color ink. Finally, the drum unit of the second color is interchanged by a drum unit of a third color and the print sheet which has already been printed with the two colors is overlappingly printed by third color ink.

In such a case, the drum unit of the first color stays to be mounted to the apparatus. The pertinent information of the non-operational time period since the use at a preceding time can be provided and accordingly, the auto idling operation can be carried out in respect of the drum as necessary, so that failure can be prevented.

However, information of the non-operational time period for the drum unit of the second color, which is substituted for the drum unit of the first color and is mounted to the apparatus, is calculated with a time point of finishing the printing operation by the first color drum as a reference and the auto idling operation is not carried out when the printing operation is carried out without interposing a time interval and accordingly, failure occurs in the printing operation by the second color. Also in respect of the drum unit of the third color, similar to the case of the second color, failure occurs.

Hence, when a plurality of drum units is used to interchange in multiple color printing or the like, the printing operation is obliged to carry out by a larger number of printed sheets by previously anticipating failure of the second color and the third color, which consumes labor, time and cost.

The present invention has been carried out in order to resolve the above-described problem and it is an object thereof to provide a stencil printing apparatus producing printed matter having no image blur or a dispersion of print density without causing failure even when the apparatus is used by interchanging drums.

SUMMARY OF THE INVENTION

According to a first aspect of this invention, there is provided a stencil printing apparatus including a main body, a drum unit having a drum substantially in a cylindrical shape and attachable to and detachable from the main body, drum detecting means for detecting a kind of the drum unit mounted to the main body and control means for carrying out an auto idling operation prior to a successive perforating operation in at least a case when a non-operational time period of the main body exceeds a previously set time period and a case when the drum detecting means detects interchanging of the drum unit.

According to a second aspect of this invention, there is provided a stencil printing apparatus including a main body, a drum unit having a drum substantially in a cylindrical shape and attachable to and detachable from the main body, drum detecting means for detecting a kind of the drum unit mounted to the main body, storing means for storing time at which the main body is finally used and control means for carrying out an auto idling operation prior to a successive perforating operation in at least a case when a non-operational time period of the main body which is calculated from the time of finally using the main body and current time exceeds a previously set time period and a case when the drum detecting means detects interchanging of the drum unit.

According to a third aspect of this invention, there is provided a stencil printing apparatus including a main body, a drum unit having a drum substantially in a cylindrical shape and attachable to and detachable from the main body and control means for carrying out an auto idling operation prior to a successive perforating operation when a non-operational time period of the drum unit exceeds a previously set time period.

According to a fourth aspect of this invention, there is provided a stencil printing apparatus including a main body, a drum unit having a drum substantially in a cylindrical shape and attachable to and detachable from the main body, storing means for storing time at which the drum unit is finally used and control means for carrying out an auto idling operation prior to a successive perforating operation when a non-operational time period of the drum unit which is calculated from time stored to the storing means and current time exceeds a previously set time period.

According to a fifth aspect of this invention, there is provided the stencil printing apparatus according to any one of the first through the fourth aspects wherein the auto idling operation is carried out by pressing the drum wrapped with a stencil sheet in an unperforated state and a press roller capable of being brought into contact with or detached from the drum by a predetermined number of times.

According to a sixth aspect of this invention, there is provided the stencil printing apparatus according to any one of the first through the fourth aspects, further including an internally pressing roller brought into internal contact with the drum for bulging a portion of a circumference of the drum to an outer side and a back pressing roller arranged at a position in contact with an outer periphery of the drum when the drum is bulged, wherein the auto idling operation is carried out by pressing the drum and the back pressing roller by a predetermined number of times.

According to a seventh aspect of this invention, there is provided the stencil printing apparatus according to any one of the first through the fourth aspects wherein the auto idling operation is carried out by interposing a sheet member between the drum and a press roller capable of being brought into contact with and detached from the drum and pressing the drum and the press roller by a predetermined number of times.

According to an eighth aspect of this invention, there is provided the stencil printing apparatus according to any one of the second through the fourth aspects wherein the storing means is provided to the drum unit.

According to a ninth aspect of this invention, there is provided the stencil printing apparatus according to the fourth aspect, further including drum detecting means for detecting kinds of the drum units mounted to the main body, wherein the storing means is provided to the main body and includes a plurality of storing areas in correspondence with the kinds of the drum units detected by the drum detecting means.

According to the present invention, the control means calculates the non-operational time period of a mounted drum unit when the drum unit is interchanged and mounted to a main body in the case where a plurality of the drum units is used in carrying out multiple color printing or the like. Further, when the non-operational time period exceeds a previously set time period, the control means determines as necessary and executes the auto idling.

Therefore, even when the drum unit which has been left for a long period of time, is used, a normal printing operation can be carried out immediately, failure is not caused and printed matter having no image blur or density dispersion can be provided.

DETAILED DESCRIPTION (First Embodiment)

Figure 1:
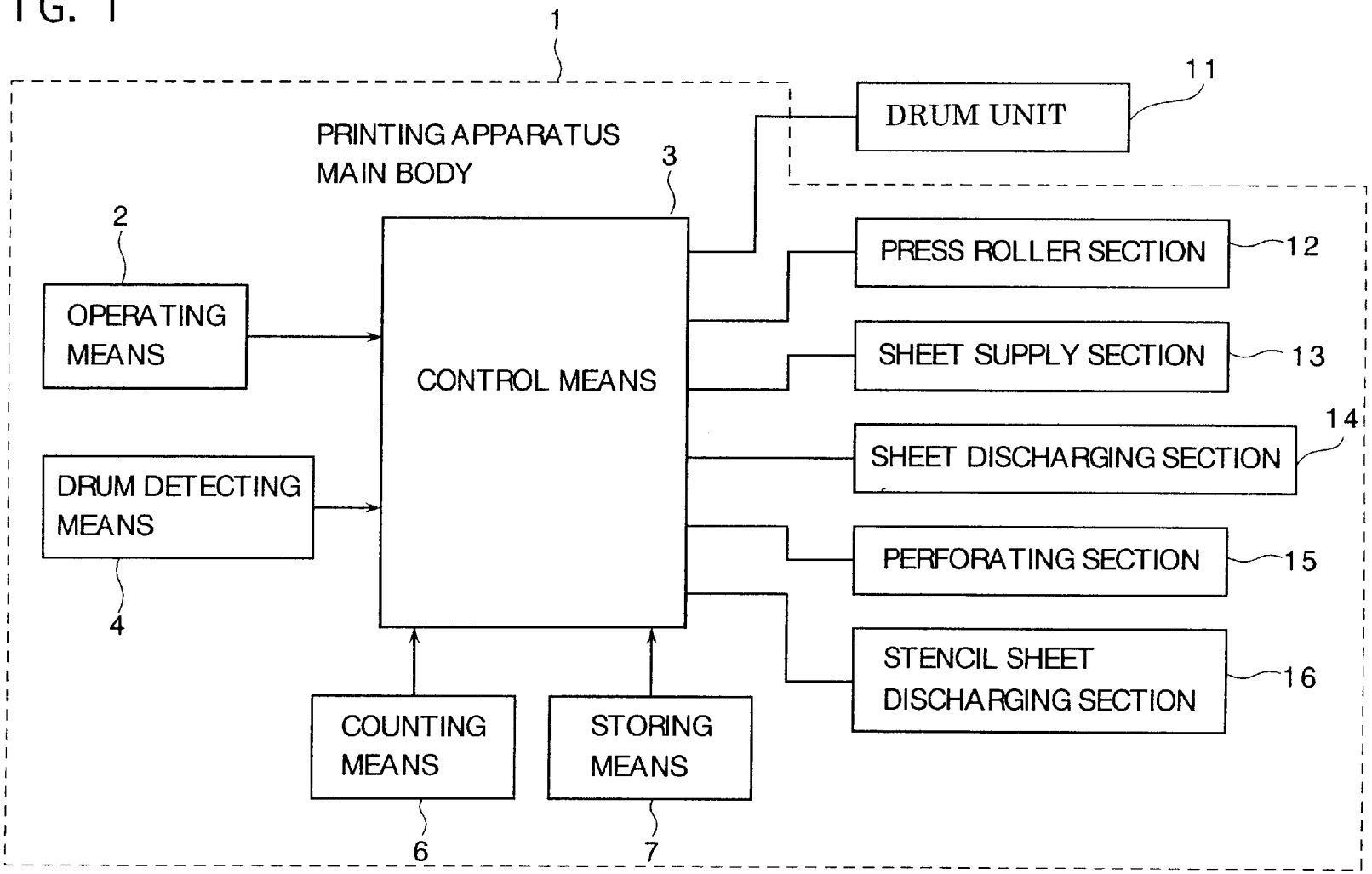
FIG. 1 is a block diagram showing a constitution of a first embodiment according to the present invention.
Figure 2:
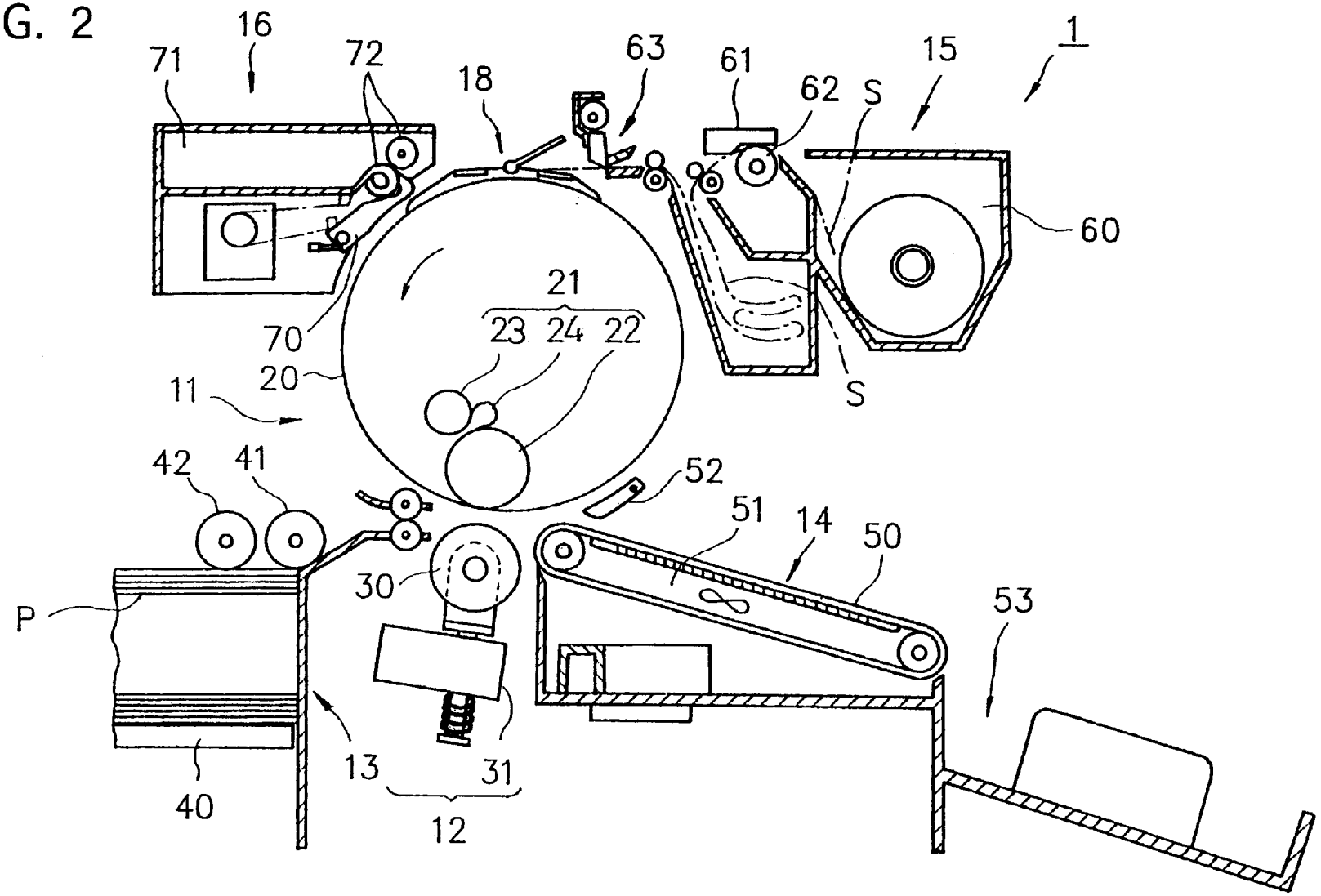
FIG. 2 is a side view showing a stencil printing apparatus according to the present invention.

FIG. 1 is a block diagram showing a constitution of a first embodiment of a stencil printing apparatus according to the present invention and FIG. 2 is a side view showing the constitution of the apparatus.

The printing apparatus is constituted of a main body 1 and a drum unit 11 provided attachably to and detachably from the main body 1.

A main body 1 is provided with operating means 2, control means 3, drum detecting means 4, counting means 6, storing means 7, a press roller section 12, a sheet supply section 13, a sheet discharging section 14, a perforating section 15 and a stencil sheet discharging section 16.

As shown by FIG. 2, according to the drum unit 11, a drum 20 which is a cylindrical member having a porous structure is axially supported by a frame rotatably by a drive mechanism, not illustrated. The drum unit 11 is so constituted that it can attach to or detach from the main body 1 while opening a front face panel thereof.

There is provided ink supplying means 21 supported by the frame at an inner portion of the drum 20. The ink supplying means 21 is constituted by a squeegee roller 22 rotated in accordance with rotation of the drum 20 while being brought into contact with an inner peripheral face of the drum 20, a doctor roller 23 arranged at an outer peripheral face of the squeegee roller 22 with a predetermined clearance therebetween and an ink storage 24.

Further, an attachable and detachable ink bottle, an ink pump for sucking ink in the ink bottle and a distributor for supplying sucked ink to the ink storage 24 are arranged at an inner portion of the drum 20 via the frame.

Therefore, when the drum 20 is driven to rotate in an arrow mark direction, ink in the ink storage 24 is supplied to the inner peripheral face of the drum 20.

The press roller section 12 is constituted such that a press roller 30 installed on the downward side of the drum 20 can be pressed to be capable of being brought into contact with and detached from the outer peripheral face of the drum 20 by operating pressing means 31 of a solenoid or the like in synchronism with transfer of print sheet. P.

The sheet supply section 13 is provided with a sheet supply base 40 mounted with a plurality of sheets P and a handling roller 41 and a supply roller 42 for taking out the print sheet P at the topmost face.

When the fed print sheet P passes through an intermediary between the drum 20 and the press roller 30, ink which has passed through perforated portions of stencil sheet S which is wrapped around the outer peripheral face of the drum 20 is transcribed onto the print sheet P to thereby form printed image.

The sheet discharging section 14 is constituted of a belt conveyor 50 for transferring the print sheet P, sucking means 51 such as a fan or the like for sucking the printed sheet P to the belt conveyor 50 and a peeling claw 52 for peeling off the print sheet P from the drum 20 and transfers the print sheet P to a sheet discharging tray 53.

The perforating section 15 is provided with a stencil sheet storing section 60 for storing the stencil sheet S in a roll shape, a thermal head 61 as well as a platen 62 and cutting means 63 such as a cutter or the like for cutting the stencil sheet S. The thermal head 61 is inputted with draft image data to be printed from a scanner or an external device.

The stencil sheet discharging section 16 is provided with a peeling claw 70 for peeling off the stencil sheet S after having finished with printing from the drum 20 and stencil sheet discharging rollers 72 for supplying the peeled-off stencil sheet S into a stencil sheet discharging box 71.

The outer peripheral face of the drum 20 is provided with a clamp plate 18 for locking one end portion of the stencil sheet S which has been wrapped after the perforating operation.

The operating means 2 is provided with ten keys for setting a number of sheets of printing, a printing start key, a perforation start key, a printing stop key and a display section of an LCD or the like for displaying the number of sheets of printing and so on. Further, a set time period for executing the auto idling is also inputted by the operating means 2.

The control means 3 is constituted by computer apparatus of CPU, ROM, RAM and the like for controlling respective portions of the main body 1 to carry out perforating operation and printing operation and particularly provided with a function of monitoring the auto idling operation according to the present invention.

As described later, the auto idling operation is carried out when a non-operational time period of the main body 1 or a non-operational time period of the drum unit 11 mounted to the printing machine main body 1 exceeds a previously set time period.

In carrying out the auto idling operation, while discharging the stencil sheet S wrapped to the drum 20 by the stencil sheet discharging section 16, the stencil sheet S as unperforated is wrapped around the drum 20 from the perforating section 15. At this moment, the print sheet P is prohibited to supply from the sheet supply section 13. There is a constitution in which the press roller 30 of the press roller section 12 is made to carry out pressing operation by a predetermined number of times while rotating the drum 20 wrapped with the stencil sheet S in the unperforated state.

By the auto idling operation, the inner face of the drum 20 is replenished with ink having an amount necessary and sufficient for carrying out normal printing by which ink can be filled into perforations of the drum 20.

The drum detecting means 4 is constituted of switches and sensors for detecting whether the drum unit 11 is mounted to the main body 1 and the kind (for example, ink colors) of the drums 20.

For example, the drum unit 11 includes switches for setting the kinds which are detected by the side of the main body 1. Further, there may have a constitution in which a physical difference (for example, detection piece or the like) is provided to the drum unit 11 and the difference is identified by detecting a relative position of the detection piece by a switch or a sensor provided to the side of the main body 1. Further, there may have a constitution in which the drum unit 11 is provided with a dip switch, a rotary switch or the like; set classification is stored and held by the drum unit 11 per se; and by mounting the drum to the main body 1, stored content is read by communication and the classification is identified.

The counting means 6 is constituted by timers and counts the non-operational time period (non-operational time period) from the printing operation prior to using the drum unit 11 mounted to the apparatus to new printing operation. Not only the non-operational time period in respect of the printing operation is counted but also the non-operational time period is similarly counted also in respect of the perforating operation. The counting means 6 can be substituted by timers built in CPU of the control means 3.

The storing means 7 is constituted by nonvolatile storing elements such as EEPROM or the like and stores time (day, time or the like) in finishing the perforating operation or printing operation. Further, a set time period inputted by the operating means 2 is also stored to the storing means 7. Further, there is used one for holding the stored content regardless of presence or absence of power supply.

Figure 3:
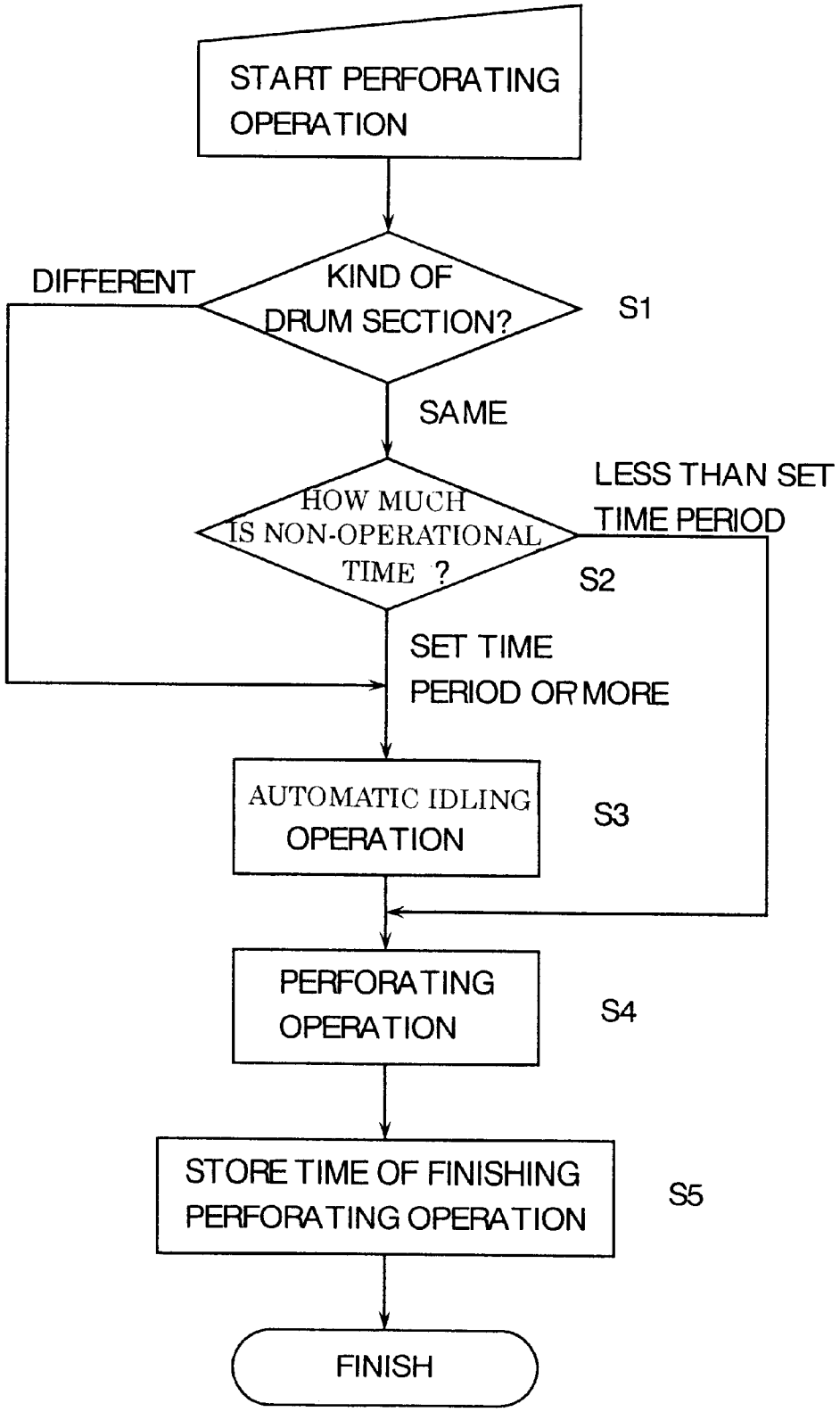
FIG. 3 is a flowchart showing an operation of monitoring an auto idling operation.

Next, an explanation will be given of the above-described operation of monitoring the auto idling operation in reference to a flowchart of FIG. 3.

At first, in starting the perforating operation, the kind of the drum unit 11 is detected and whether the kind of the drum unit 11 is the same as one which has been used before, is determined (S1). The kind of the drum unit 11 detected by the drum detecting means 4 is compared with the kind of the drum unit 11 used before and stored to the storing means 7.

Further, when the kind of the drum unit 11 is different therefrom (S1-different), after carrying out the auto idling operation (S3), the perforating operation is carried out (S4).

In the meantime, when the kind of the drum unit 11 is the same therewith at S1 (S1-same), the non-operational time period of the main body 1 is compared with the set time period (S2). For example, the non-operational time period from a time point stored to the storing means 7 to a current time point is calculated and compared with the set time period stored to the storing means 7.

Further, when the non-operational time period of the main body 1 is equal to or more than the set time period, the above-described auto idling operation is carried out (S3) and the perforating operation is carried out (S4)

When the non-operational time period of the main body 1 is less than the set time period, the auto idling operation is not carried out and the perforating operation is carried out (S4)

After executing the perforating operation at S4, time (day and time) in finishing the perforating operation is updated and stored to the storing means 7 (S5)

According to the above-described perforating operation, when the drum 20 differs from the drum 20 which has been subjected to the perforating operation or used in the printing operation, the auto idling operation is automatically carried out.

Figure 4:
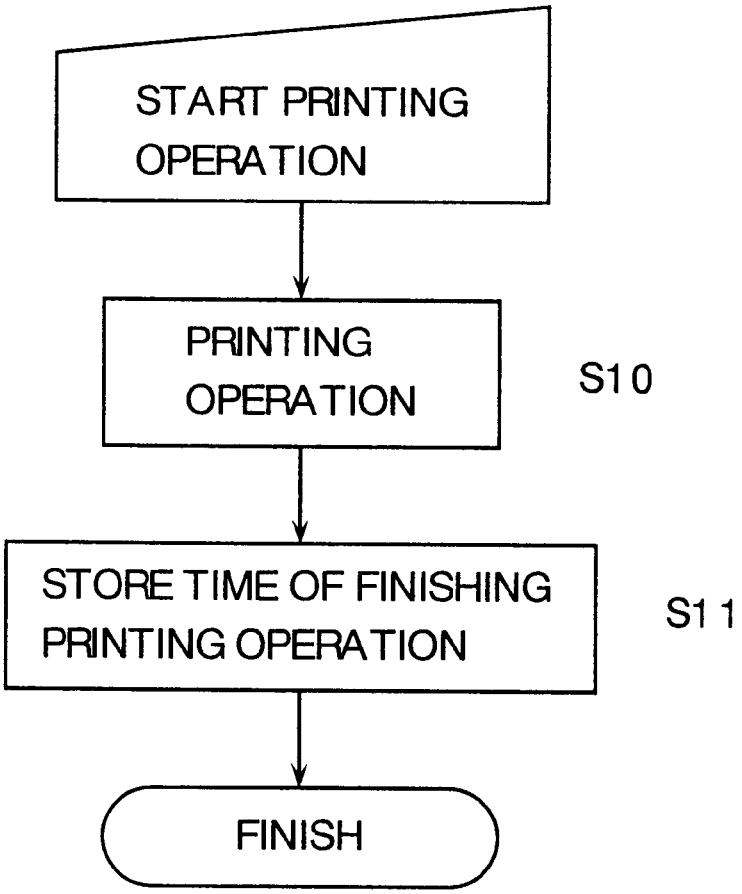
FIG. 4 is a flowchart in a printing operation.

FIG. 4 is a flowchart in the printing operation.

When the printing operation is started, respective portions of the main body 1 and the d rum unit 11 are operated to thereby carry out the printing operation (S10), thereafter, time (day, time) in finishing the printing operation is updated and stored to the storing means 7 (S11).

In this way, whenever the perforating operation and the printing operation are finished, the latest time of finishing the operation is stored Lo the storing means 7 at which the final perforating operation or printing operation is carried out, and is always updated and stored to the storing means 7.

According to the monitoring control mentioned above, even when there is a plurality of the drum units 11 by which the perforating operation or printing operation is not carried out and which has been left for a long period of time, the auto idling operation is carried out to the drum units 11 before the perforating operation. Therefore, image blur or a dispersion in print density can be eliminated in the image on the print sheet P and failure can be prevented.

(Second Embodiment)

Next, an explanation will be given of a second embodiment according to the present invention.

Figure 5A:
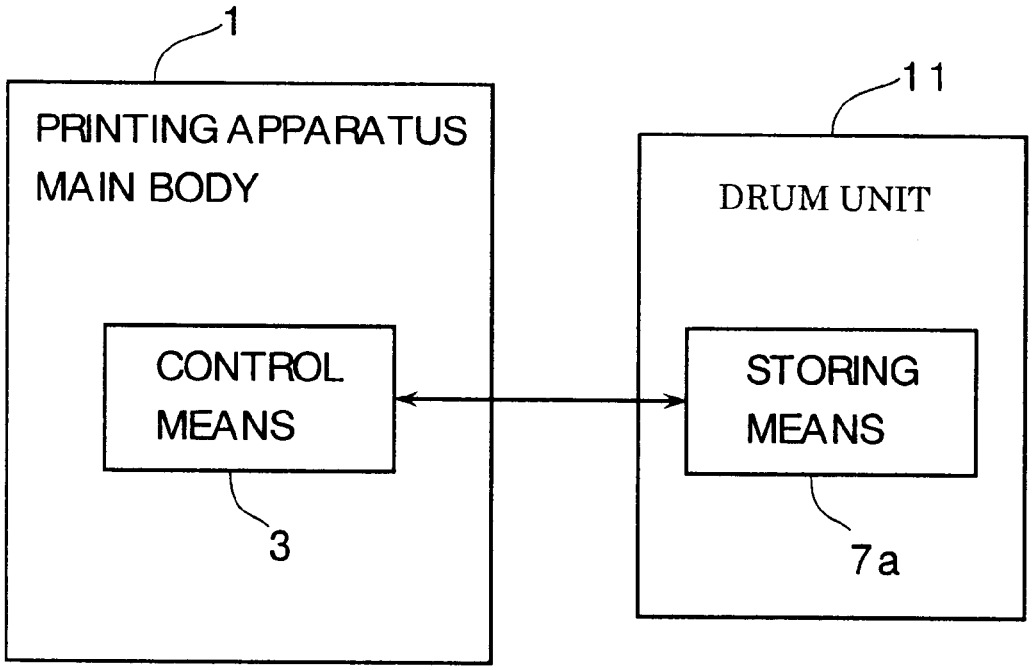
FIGS. 5(*a*) and 5(*b*) are constitution diagrams of a second embodiment according to the present invention.
Figure 5B:
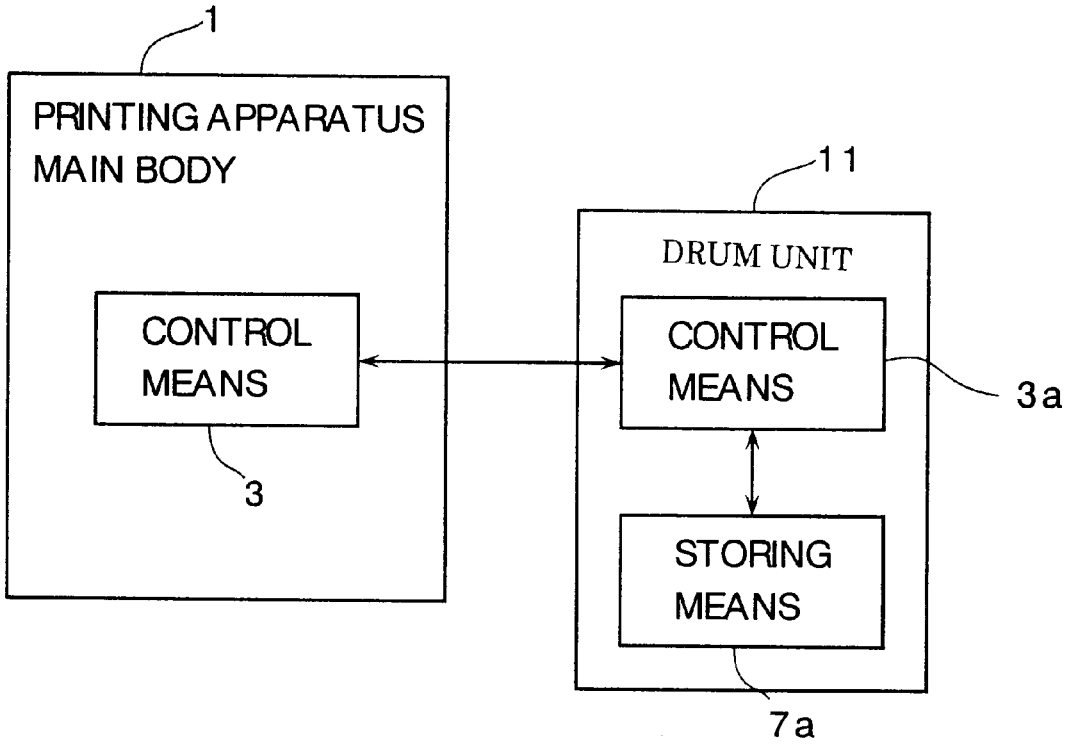

According to the embodiment, as shown by constitution diagrams of FIGS. 5(*a*) and 5(*b*), each drum unit 11 is provided with storing means.

For example, in a constitution example shown by FIG. 5(*a*), storing means 7*a* is mounted to the drum unit 11. Further, the control means (CPU) 3 in the main body 1 makes the storing means 7*a* store the time of finishing the above-described perforating operation and printing operation at the end of every operation and reads the time.

Further, as shown by FIG. 5(*b*), there may have a constitution in which the drum unit 11 is mounted with control means 3*a* and the storing means 7*a*. In this case, data of the time stored to the storing means 7*a* is transmitted and received by communication between the control means (CPU) 3 on the side of the main body 1 and the control means 3*a* in the drum unit 11. Further, the control means 3*a* in the drum unit 11 makes the storing means 7*a* store at the time of finishing the perforating operation and printing operation at the end of every operation.

Figure 6:
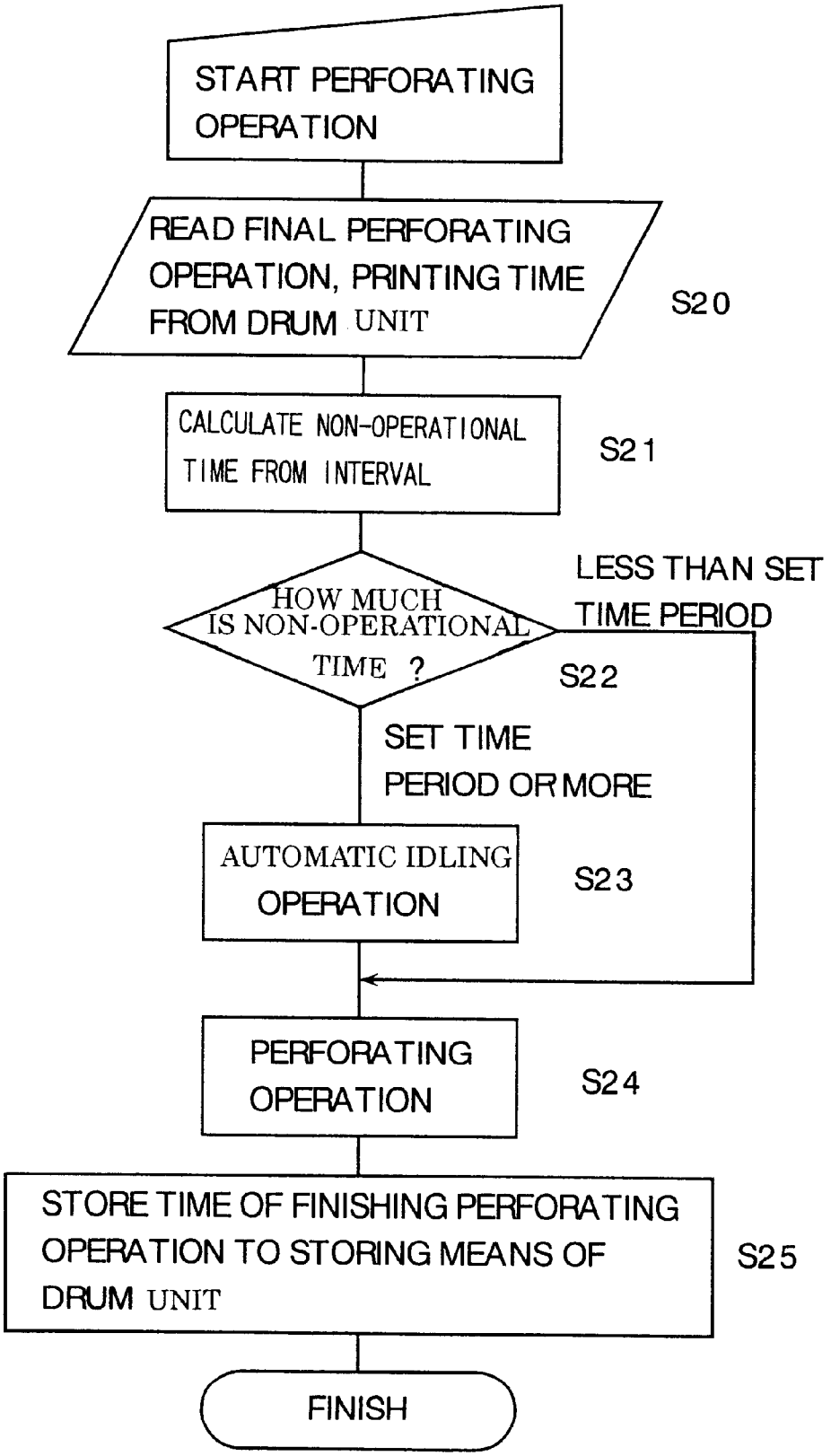
FIG. 6 is a flowchart showing an operation of monitoring an auto idling according to the second embodiment.

FIG. 6 is a flowchart showing the operation of monitoring an auto idling according to the second embodiment.

In starting the perforating operation, the control means 3 (or 3*a*) reads time (day, time) of finally carrying out the perforating operation or printing operation from the storing means 7*a* in the drum unit 11 (S20).

Next, the non-operational time period is calculated based on an interval between current time (day, time) and the time of finishing the final operation (S21).

When the calculated non-operational time is equal to or more than a set time period (S22), the auto idling operation is carried out (S23) and the operation proceeds to the perforating operation (S24).

In the meantime, when the non-operational time is less than the set time period (S22), the auto idling operation is not carried out and the operation proceeds to the perforating operation (S24).

After finishing the perforating operation, the time of finishing the perforating operation is stored to the storing means 7*a* of the drum unit 11 (S25).

Figure 7:
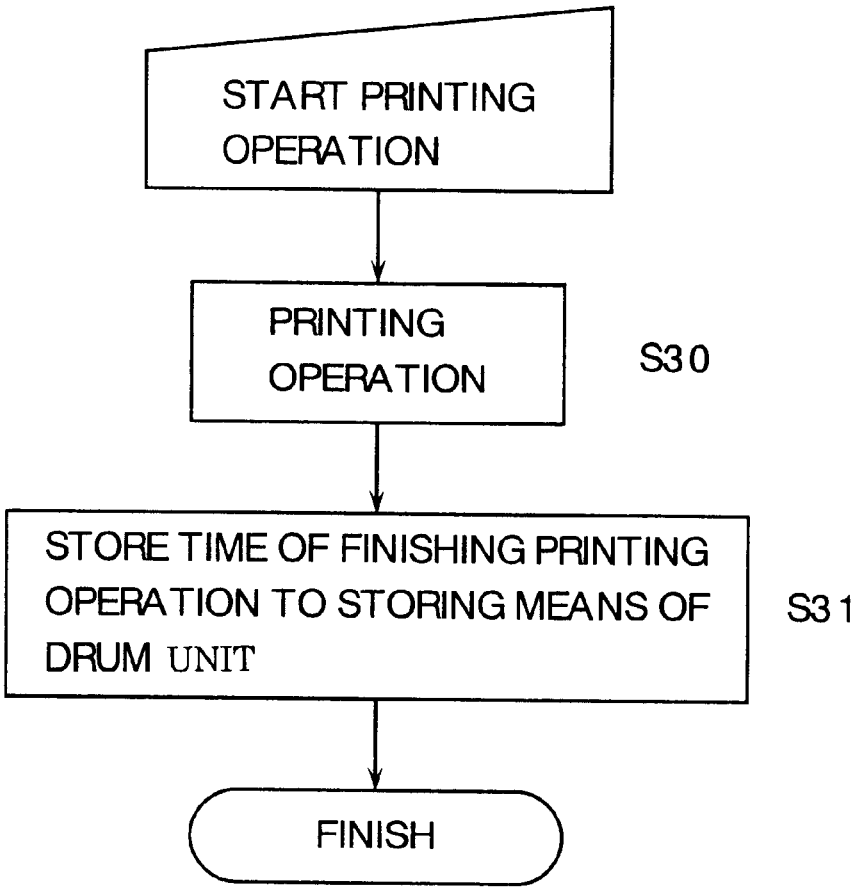
FIG. 7 is a flowchart in a printing operation according to the second embodiment.

FIG. 7 is a flowchart in carrying out the printing operation according to the second embodiment.

In the second embodiment, when the printing operation is started, the respective portions of the main body 1 and the drum unit 11 are operated to thereby carry out the printing operation (S30), thereafter, time (day, time) in finishing the printing operation is updated and stored to the storing means 7*a* provided to the drum unit 11 (S31).

According to the second embodiment, the auto idling operation is carried out only in respect of the drum unit 11 which has been left for a long period of time and failure can be eliminated.

Further, in respect of the drum unit 11 which does not necessitate the auto idling operation, the wasteful auto idling operation is not carried out and wasteful time and waste of the stencil sheet S can be prevented.

(Third Embodiment)

Next, an explanation will be given of a third embodiment according to the present invention.

Figure 8:
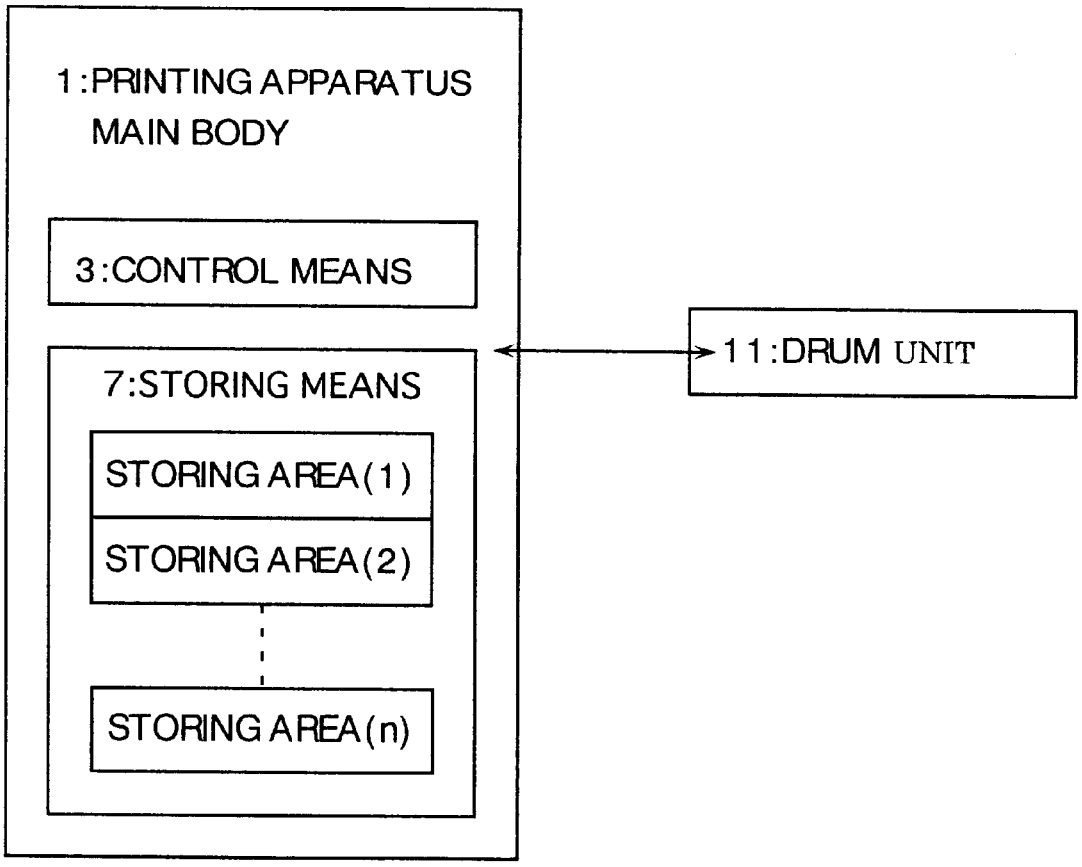
FIG. 8 is a constitution diagram of a third embodiment of the present invention.

According to the embodiment, as shown by a constitution diagram of FIG. 8, the storing means 7 is provided in the main body 1 and there are storing areas (1, 2, ., n) for storing the latest time of perforating and printing operation in correspondence with the respective drum units 11 (1, 2, ., n) in the storing means 7.

Figure 9:
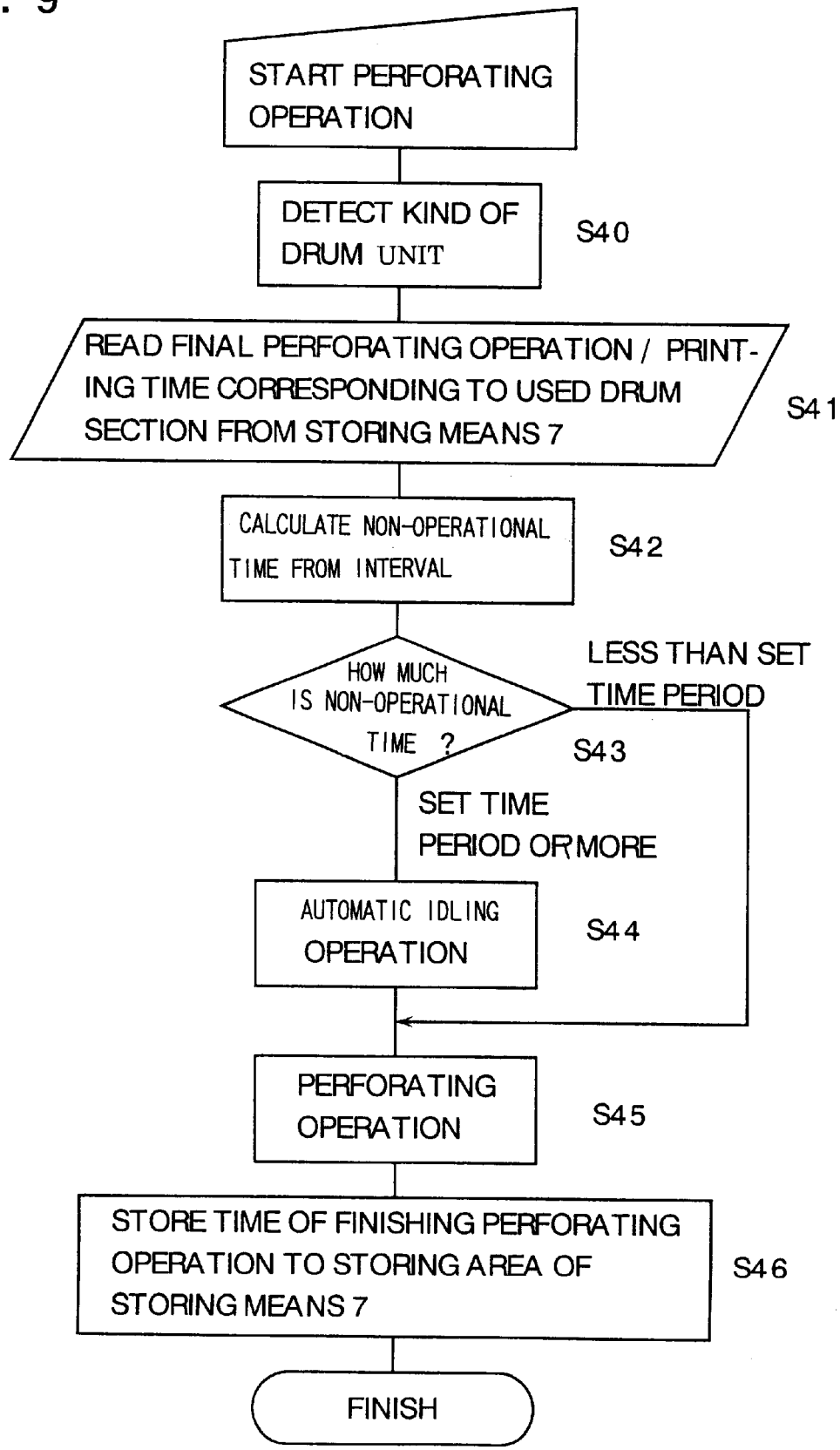
FIG. 9 is a flowchart showing an operation of monitoring an auto idling according to the third embodiment.

FIG. 9 is a flowchart showing the operation of monitoring the auto idling operation according to the third embodiment.

In starting the perforating operation, the control means 3 detects the kind of the drum unit 11 which is currently set (S40), and reads the latest time of perforating and printing operation in correspondence with the detected drum unit 11 from a corresponding storing area (S41).

Next, the non-operational time period is calculated based on an interval between the current time (day, time) and the time of finishing the final operation (S42).

When the calculated non-operational time period is equal to or more than a set time period (S43), the auto idling operation is carried out (S44) and the operation proceeds to the perforating operation (S45).

In the meantime, when the non-operational time period is less than the set time period (S43), the auto idling operation is not carried out and the operation proceeds to the perforating operation (S45).

After finishing the perforating operation, the latest time of finishing the perforating operation is stored to the corresponding storing area of the storing means 7 (S46).

Figure 10:
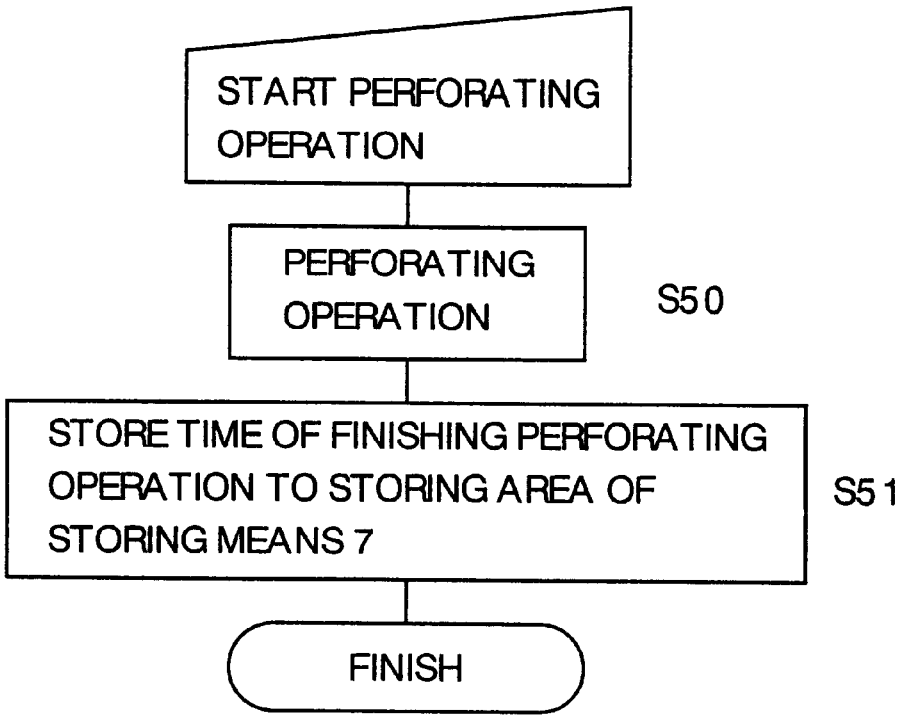
FIG. 10 is a flowchart in a printing operation according to the third embodiment.

FIG. 10 is a flowchart in carrying out a printing operation according to the third embodiment.

According to the third embodiment, when the printing operation is started, the respective portions of the main body 1 and the drum unit 11 are operated to carry out the perforating operation (S50), thereafter, latest time (day, time) of finishing the perforating operation is stored to a corresponding storing area of the storing means 7 (S51).

According to the third embodiment, the auto idling operation is carried out only in respect of the drum unit 11 which has been left for a long period of time and failure can be eliminated.

Further, there is no need of providing storing means for storing the latest time of perforating and printing operations in the drum unit 11 and accordingly, pertinent auto idling operation can be carried out without reforming the existing drum unit 11.

Further, there may have a constitution in which the non-operational time period of the drum unit 11 at time of supplying power to the printed apparatus main body 1 or setting the drum unit 11 to the main body 1 is calculated and when the auto idling operation is needed, the operation is carried out when the perforating operation is carried out. Therefore, whether the auto idling operation is to be carried out can be determined whenever the power is supplied and the drum unit 11 is mounted.

Further, the auto idling operation according to the above-described embodiments is carried out after depressing a perforation start key of the operating means 2.

The present invention is not limited thereto but there may have a constitution in which whether the auto idling operation is to be carried out is determined whenever the power is supplied and the drum unit 11 is mounted and the auto idling operation is automatically carried out immediately without awaiting for operating the perforation start key when necessary. Therefore, the auto idling operation is not carried out when the perforating operation is intended to execute, the perforating operation time period can be prevented from being prolonged unnecessarily and the perforating operation can immediately be carried out. In this case, in finishing the auto idling operation, the time of finishing the operation is updated and stored to the storing means 7 or 7*a*.

Further, although according to the auto idling operation explained in the above-described respective embodiments, the stencil sheet S in an unperforated state is reeled out from the perforating section 15 and wrapped around the drum 20 and pressing operation is executed by the drum 20 and the press roller 30, but the present invention is not limited thereto.

For example, there may have a constitution in which in place of the above-described print sheet P, a sheet member disclosed in Japanese Unexamined Patent Publication No. 4-129787 is used and the sheet member is made to move in and out freely between the drum 20 and the press roller section 30. According to the constitution, the auto idling operation can be carried out by using a stencil sheet which has already been mounted, further, the print sheet P is not used wastefully.

Further, although according to the stencil printing apparatus used in the above-described respective embodiments, the press roller 30 is constituted to be capable of being brought into contact with or detached from the drum 20, the present invention is not limited thereto. For example, the present invention is applicable to an apparatus described in Japanese Unexamined Patent Publication No.7-132671. The apparatus is provided with an inner pressing roller which is brought into inner contact with a drum and is movable at an inner portion of the drum, and a portion of a circumference of which is bulged in an outward direction in a drum unit. Further, there is arranged a back pressing roller having a diameter substantially the same as a diameter of the drum in place of the press roller at a position in contact with an outer peripheral face of the drum when the drum is bulged by the inner pressing roller. Then, the apparatus provides a desired image by bringing a print sheet into press contact between the drum bulged by the internally pressing roller and the back pressing roller to thereby transfer the print sheet.

According to the auto idling operation by using the apparatus, the drum and the back pressing roller are pressed to each other by a predetermined number of times. At this occasion, unperforated stencil sheet may be wrapped around the drum or the sheet member may be interposed between the drum and the back pressing roller.

According to the present invention, when the non-operational time period of the printing apparatus main body exceeds a predetermined time period or when a different kind of the drum unit is mounted to the printing machine main body, prior to the successive perforating operation, the auto idling operation is executed and therefore, even with the printing operation by using the drum unit which has not been used for a long period of time, failure is not caused, from the first sheet immediately after starting to use the apparatus, so that a printed sheet having no image blur or density dispersion can be provided. Particularly, even when the printing operation in which a plurality of the drum units is interchanged and used in multiple color printing or the like, is executed, wasteful paper is not produced.

Further, according to the present invention, the non-operational time period can be provided for the respective drum units and accordingly, when the non-operational time period of the drum unit currently mounted exceeds the predetermined time period, the autoidling operation can be carried out prior to the successive perforating operation and accordingly, the auto idling operation can be executed at a pertinent timing in correspondence with the individual drum unit.

Further, since the storing means is provided, whether the auto idling operation is needed for the drum unit can simply be determined only by reading the time of finishing the perforating operation or printing operation from the storing means when the respective drum unit is mounted.

Further, the latest time to be stored in the storing means is updated and stored when the perforating operation is finished and when the printing operation is finished, that makes the non-operational time of the drum unit in use more accurate, and the auto idling operation can be executed at a pertinent time.

The storing means can be provided to the drum unit or the printing machine main body. When the storing means is provided to the drum unit, in accordance with mounting the drum unit, only by reading the latest time from the storing means, whether the auto idling operation is needed for the drum unit can simply be determined. Further, even when one drum unit is commonly used in a plurality of printing machine main bodies, pertinent auto idling operation can always be executed. With a constitution in which the storing means is provided to the printing machine main body, a pertinent idling operation can be executed by using an existing drum unit as it is without reforming the existing drum unit.

What is claimed is:

1. A stencil printing apparatus comprising:

a main body, a drum unit installed in the main body and having a drum substantially in a cylindrical shape, said drum unit being exchangeable to another drum unit, drum detecting means arranged to cooperate with the drum unit for detecting a kind of the drum unit mounted on the main body, and control means electrically connected to the drum detecting means, said control means receiving a signal from the drum detecting means, and in case the signal indicates that the drum unit is changed to another drum unit, allowing an auto idling operation for the another drum unit prior to a next perforating operation.

2. A stencil printing apparatus according to claim 1, further comprising a press roller to be able to contact the drum installed in the main body, said drum being wrapped with a stencil sheet without perforation and rotated and contacted with the press roller for a predetermined number of times in the automatic idling operation.

3. A stencil printing apparatus according to claim 1, further comprising an inner pressing roller situated inside the drum to internally contact the drum for bulging a portion of a circumference of the drum to an outer side; and a back pressing roller arranged at a position contacting an outer periphery of the drum when the drum is bulged, said automatic idling operation being carried out by pressing the drum and the back pressing roller for a predetermined number of times.

4. A stencil printing apparatus according to claim 1, further comprising a press roller to be able to contact the drum installed in the main body, said automatic idling operation being carried out by interposing a sheet member between the drum and the press roller for a predetermined number of times.

5. A stencil printing apparatus comprising:

a main body, a plurality of different kinds of drum units, each having a drum substantially in a cylindrical shape and being detachably attached to the main body, one of the drum units being selected and exchangeably attached to the main body, drum detecting means arranged to cooperate with the drum unit for detecting the kind of the drum unit mounted on the main body, and control means electrically connected to the drum detecting means, said control means receiving a signal from the drum detecting means, and in case the signal indicates that the drum unit on the main body is changed to another drum unit, allowing an auto idling operation for the another drum unit prior to a next perforating operation.

6. A stencil printing apparatus according to claim 5, further comprising a press roller to be able to contact the drum installed in the main body, said drum being wrapped with a stencil sheet without perforation and rotated and contacted with the press roller for a predetermined number of times in the automatic idling operation.

7. A stencil printing apparatus according to claim 5, further comprising an inner pressing roller situated inside the drum to internally contact the drum for bulging a portion of a circumference of the drum to an outer side; and a back pressing roller arranged at a position contacting an outer periphery of the drum when the drum is bulged, said automatic idling operation being carried out by pressing the drum and the back pressing roller for a predetermined number of times.

8. A stencil printing apparatus according to claim 5, further comprising a press roller to be able to contact the drum installed in the main body, said automatic idling operation being carried out by interposing a sheet member between the drum and the press roller for a predetermined number of times.

9. A stencil printing apparatus comprising:

a main body, a drum unit installed in the main body and having a drum substantially in a cylindrical shape, said drum unit being exchangeable to another drum unit, and control means arranged to associate with the drum unit, said control means detecting if a non-operational time period of the drum unit now installed in the main body exceeds a previously set time period, and allowing the drum unit installed in the main body to perform an automatic idling operation prior to a next perforating operation when the non-operational time period exceeds the previously set time period.

10. A stencil printing apparatus according to claim 9, further comprising a press roller to be able to contact the drum installed in the main body, said drum being wrapped with a stencil sheet without perforation and rotated and contacted with the press roller for a predetermined number of times in the automatic idling operation.

11. A stencil printing apparatus according to claim 9, further comprising an inner pressing roller situated inside the drum to internally contact the drum for bulging a portion of a circumference of the drum to an outer side; and a back pressing roller arranged at a position contacting an outer periphery of the drum when the drum is bulged, said automatic; idling operation being carried out by pressing the drum and the back pressing roller for a predetermined number of times.

12. A stencil printing apparatus according to claim 9, further comprising a press roller to be able to contact the drum installed in the main body, said automatic idling operation being carried out by interposing a sheet member between the drum and the press roller for a predetermined number of times.

13. A stencil printing apparatus comprising:

a main body, a plurality of different kinds of drum units, each having a drum substantially in a cylindrical shape and being detachably attached to the main body, one of the drum units being selected and exchangeably attached to the main body, storing means arranged to associate with each of the drum units for storing last using time for each of the drum units, and control means electrically connected to the storing means, said control means detecting if a non-operational time period of the drum unit now mounted in the main body, which is calculated from the last using time stored in the storing means and a current time, exceeds a previously set time period, and allowing the drum unit installed in the main body to perform an automatic idling operation prior to a next perforating operation when the non-operational time period exceeds the previously set time period.

14. A stencil printing apparatus according to claim 13, wherein the storing means is provided at each of the drum units.

15. A stencil printing apparatus according to claim 13, further comprising drum detecting means for detecting the kind of the drum unit mounted on the main body, said storing means being provided in the main body and having a plurality of storing areas, each storing area corresponding to the kind of the drum unit detected by the drum detecting means.

16. A stencil printing apparatus according to claim 13, further comprising a press roller to be able to contact the drum installed in the main body, said drum being wrapped with a stencil sheet without perforation and rotated and contacted with the press roller for a predetermined number of times in the automatic idling operation.

17. A stencil printing apparatus according to claim 13, further comprising an inner pressing roller situated inside the drum to internally contact the drum for bulging a portion of a circumference of the drum to an outer side; and a back pressing roller arranged at a position contacting an outer periphery of the drum when the drum is bulged, said automatic idling operation being carried out by pressing the drum and the back pressing roller for a predetermined number of times.

18. A stencil printing apparatus according to claim 13, further comprising a press roller to be able to contact the drum installed in the main body, said automatic idling operation being carried out by interposing a sheet member between the drum and the press roller for a predetermined number of times.

* * * * *